US008387259B2

(12) United States Patent
Starr

(10) Patent No.: US 8,387,259 B2
(45) Date of Patent: Mar. 5, 2013

(54) DUAL HEADED RAZOR BLADE SYSTEM

(76) Inventor: Carol Starr, Wixom, MI (US)

( * ) Notice: Subject to any disclaimer, the term of this patent is extended or adjusted under 35 U.S.C. 154(b) by 162 days.

(21) Appl. No.: 12/858,931

(22) Filed: Aug. 18, 2010

(65) Prior Publication Data

US 2011/0041342 A1 Feb. 24, 2011

Related U.S. Application Data

(60) Provisional application No. 61/235,525, filed on Aug. 20, 2009.

(51) Int. Cl.
*B26B 21/14* (2006.01)

(52) U.S. Cl. ..... 30/50; 30/34.1

(58) Field of Classification Search ..... 30/32, 34.05, 30/34.1, 50; D28/46, 48, 53
See application file for complete search history.

(56) References Cited

U.S. PATENT DOCUMENTS 4,501,066 A * 2/1985 Sceberras ..... 30/50
5,307,564 A * 5/1994 Schoenberg ..... 30/50
6,052,905 A * 4/2000 Branchinelli et al. ..... 30/50
6,141,875 A * 11/2000 Andrews ..... 30/50
6,308,416 B1 * 10/2001 Bosy et al. ..... 30/50
7,536,787 B2 * 5/2009 Blaustein et al. ..... 30/34.05
7,937,837 B2 * 5/2011 Psimadas et al. ..... 30/34.1
2002/0023352 A1 * 2/2002 Mil'shtein ..... 30/50
2007/0283567 A1 * 12/2007 Magli ..... 30/50
2011/0010943 A1 * 1/2011 Izumi ..... 30/34.1
2011/0041342 A1 * 2/2011 Starr ..... 30/50

* cited by examiner

*Primary Examiner* — Hwei C Payer
(74) *Attorney, Agent, or Firm* — The Weintraub Group, P.L.C.

(57) ABSTRACT

A dual headed razor blade system includes a first razor blade head assembly and a second razor blade head assembly. The razor blade head assemblies include an elongated in-line main handle having opposed upper and lower ends and opposed front and rear faces supports; additionally, the system includes a shorter in-line arm having opposed upper and lower ends, and opposed front and rear faces. The first razor blade head assembly is mounted to upper end of a first blade support, which in turn is mounted at the upper end and on the front face of the elongated main in-line handle; the second razor blade head assembly is mounted to the upper end of a second blade support, which in turn is mounted at the upper end of the shorter elongated in-line arm, while the lower end of the in-line arm is pivoted at a concave recess.

5 Claims, 2 Drawing Sheets

DUAL HEADED RAZOR BLADE SYSTEM

CROSS REFERENCE TO RELATED APPLICATIONS

This application is a completion application for U.S. Provisional patent application Ser. No. 61/235,525 for "DUAL HEADED RAZOR BLADE SYSTEM", filed Aug. 20, 2009, the entire disclosure of which is hereby incorporated by reference in its entirety, including the drawings and formal papers.

BACKGROUND OF THE INVENTION

1. Field of the Invention

The present invention relates in general to manual hand-held razor structures, cartridges and systems for shaving various parts of the human body. More particularly the present invention concerns dual headed razors.

2. Description of the Background Art

Shaving razors have been known in a variety of forms. Individuals employ shaving razors of various designs to tackle a variety of shaving challenges. Uni-directional and bi-directional razor blade shaving devices have long been known and used for variety of shaving purposes. The uni-directional straight-edge razor blade devices with an in-line handle have been in use by barbers for more than a century. In recent times, personal shaving by individuals has become more predominant than the shaving by barbers. Moreover, the predominant manual wet-shaving devices over at least last fifty or so years have been based upon the classic T-bar razor, with its elongated razor head and an in-line handle, which runs perpendicular from the bottom edge of the razor's blade head.

Although razor blades and razor blade cartridges are manufactured in a wide variety of configurations, the width and the number of heads of razor blades and razor blade cartridges are typically standardized. Most users find these standardized blade heads and their numbers to be sufficient. In addition to conventional single headed razor blade shaving systems, currently, there are a few dual headed razor systems available in the market. However, most of the twin headed razor blade shaving systems comprise two similarly sized heads, which are disposed in opposition in-line with and on the same side of the handle of the system, rendering them as bi-directional shaving devices. An example of such a shaving system is described in U.S. Pat. No. 6,141,875 to Edward A. Andrews. Andrews discloses an in-line razor-blade shaving device, which features two sets of razor blades strips pointing outwardly in opposite directions. Each device features an elongated handle arranged in line with an elongated bi-directional razor blade head. The edges of the blade strips of the two sets may be arranged in one common working plane, or each set may be in its own working plane, with the planes at an angle to one another. To use the system, the user's wrist rotates at the end of each stroke (or at the beginning of the next stroke), to bring the other working plane, not currently on the skin, into engagement with the skin for the next stroke in the opposite direction.

In addition, there are other twin headed razor systems available, which comprise two heads which are not equal in width, and disposed on either side of the in-line handle. The wider razor blade heads are used to shave general shaving areas, while the narrower razor blade heads are used to shape areas like mustaches, under the nose, sideburns, and areas between the eyebrows. U.S. Pat. No. 6,052,905, to Anthony Branchinelli, discloses a razor for shaving and sculpting an area of hair on a user. The razor includes a first standard size razor head, a second narrow size razor head including a telescopic member extending therefrom and a handle including a top side integrally connected to the first standard size razor head; a first recess extending through the top side and into the handle forming a compartment; and a second recess extending along a length of the handle and providing access to the compartment. The telescopic member is received by the compartment and is slideable therein. A slideable member is connected to the telescopic member and extends through the second recess for sliding the telescopic member within the compartment whereby movement of the slideable member moves the second narrow size razor head between a first extended position in which the telescopic member extends substantially totally from the compartment and a second retracted position in which the telescopic member is substantially completely received within the compartment. Alternatively, the second narrow size razor head may also be integrally connected to the handle. Finally, the narrow size razor head may also be connected to an elongated handle by itself.

Although all of these razor blade systems have their respective uses to variety of users, apparently, none have achieved the benefits of a simple aggregation of multiple razor blade heads in maximizing the shaving area for each stroke of cutting, and while minimizing the number of strokes necessary to cleanly shaving hairs from different parts of the body. Since the twin razor blade heads of the first group of razors, in which the heads are disposed on one side of the in-line handle, are disposed in opposite direction to each other, the razor fails to shave a greater shaving area utilizing both heads in each stroke of cutting. Similarly, the twin headed razor blades of the second group utilize only one of the two heads for each stroke of cutting because the heads are disposed on either side of the in-line handle. Hence, the twin headed razor blade systems disclosed in the prior art are unable to derive the benefits from the attributes of multiple razor blade heads being disposed in one direction and on one side of the in-line handle, which is capable of shaving a greater area in each stroke of cutting.

A dual headed razor blade system is needed that optimally utilizes a pluralities of blade heads, the cutting edges of which are disposed in the same direction to each other and disposed on one side of the in-line handle. A dual headed razor blade system is needed which maximizes the shaving area for each stroke of cutting and minimizes the number of strokes necessary to cleanly shaving hair from different parts of a human body.

SUMMARY OF THE INVENTION

In accordance with an illustrative embodiment of the present invention, a dual headed razor blade system is provided having a first razor blade head assembly and a second razor blade head assembly for shaving hair from general areas of the face and other parts of human body. The dual headed razor blade system includes (a) an elongated in-line main handle having opposed upper and lower ends and opposed front and rear faces;

(b) a first razor blade assembly mounted to the upper end of the handle;

(c) a relatively shorter in-line arm having opposed upper and lower ends, and opposed front and rear faces, and (d) a second razor blade head assembly disposed at the upper end of the arm.

The second razor blade head assembly sits slightly lower than and on the same plane of the first razor blade head assembly.

The main handle of the dual headed razor blade system further includes near its lower end a concave recess on its front face to receive the shorter in-line arm's lower end at its rear face. The lower end of the shorter in-line arm pivotally is attached below the concaved recess of the main handle of the dual headed razor blade system so that, the arm swings radially with an angular rotation about a vertical axis perpendicular to the front face of the main in-line handle of the dual headed razor blade system.

The first razor blade head assembly is mounted to upper end of first blade support, which in turn is mounted at the distal upper end and on the front side of the elongated main in-line handle. Additionally, to maximize the shaving area and for covering a wider width for each stroke of cutting, the second razor blade head assembly is mounted to the upper end of second blade support which, in turn, is mounted at the distal upper end of the shorter elongated in-line arm. The pivot attachment of the shorter in-line arm enables the second razor blade head assembly an angular rotation with an optimal swing on either side of the main in-line handle and covers a wider skin area of shaving for each stroke of cutting.

The first and second razor blade head assemblies preferably comprise disposable safety razor blade cartridges, which are releasably engaged to the respective upper ends of the first and second blade supports for replacement, removal, and disposal thereof.

The second razor blade head assembly extends from the relatively shorter arm's upper end and is disposed on the same plane and uni-directionally with the first razor blade head assembly. The second razor blade head assembly operates, in conjunction with the first razor blade head assembly, at all positions within the optimal range of angular rotation of the shorter in-line arm and assures that the dual headed razor blade assembly optimally covers a wider surface of skin for each stroke of cutting for shaving unwanted hair from various parts of body.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
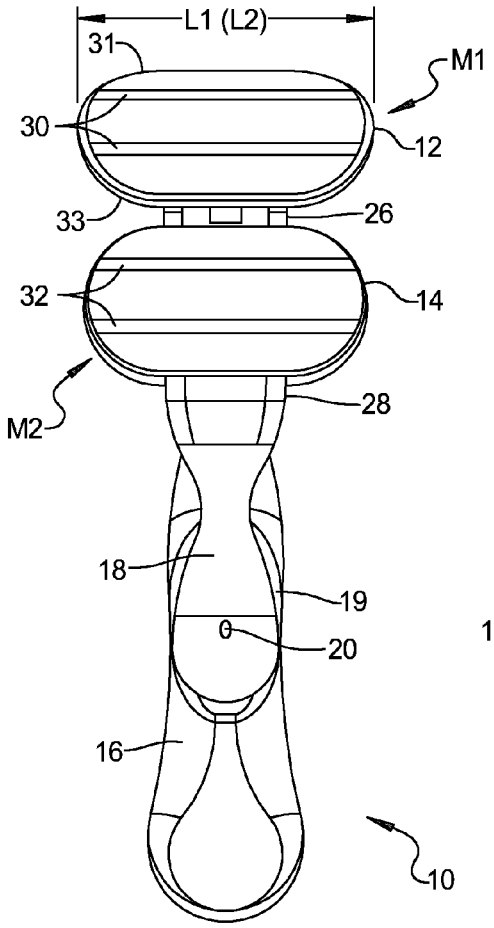
FIG. 1 is a front view of the dual headed razor blade system according to the invention.

The present invention is directed towards a dual headed razor blade system 10, as shown in FIG. 1. The dual headed razor blade system 10 includes a first razor blade head assembly 12 and a second razor blade head assembly 14 for shaving hair from the face, the legs and other parts of a human body.

As shown in FIG. 1, the first razor blade head assembly 12 has a width L1 associated therewith, and the second razor blade head assembly 14 has a width L2 associated therewith. Preferably, L1 and L2 are of equal widths enabling the second razor assembly 14 to augment the shaving surface area to a maximum with an optimal width on each stroke of cutting.

First and second razor blade head assemblies 12, 14 are, in the preferred embodiment, disposable safety razor cartridges. As shown in FIG. 1, the exemplary first razor blade head assembly 12 includes at least a pair of blades 30 mounted between a pair of opposed sidewalls 31,33 of a blade mount M1. Similarly, FIG. 1 shows the second razor blade head assembly 14 including a pair of blades 32 mounted between a pair of opposed sidewalls of a second blade mount M2. The number of razor blades within the cartridge and the dimension of sidewalls are dependent upon the width of the cartridge and the user's preference.

Although a cartridge is preferred, it should be noted that first and second razor blade head assemblies 12, 14 may comprise a single safety razor blade mounted on a suitable supporting head and the like. The disposable razor blade cartridges may further include shaving lotion applicators or any other desirable elements commonly associated with disposable razor blade cartridges.

In the preferred embodiment of the present invention, the first razor blade head assembly 12 is a conventional disposable razor blade cartridge, which is releasably mounted to the upper end of first blade support 26. Similarly, in the preferred embodiment of the present invention, the second razor blade head assembly 14 is a conventional disposable razor blade cartridge, which is releasably mounted to the upper end of second blade support 28.

As noted the dual headed razor blade system 10 includes a main elongated in-line handle 16 having opposed upper and lower ends and opposed front and rear faces. The main in-line handle 16 of the dual headed razor blade system 10 further includes near its lower end and on its front face a concave recess 19 to restingly receive the lower end of the shorter in-line arm 18 at its rear face as discussed below. The upper end of the in-line arm 18 holds the second blade support 28, while the lower end of the second handle 18 is pivotally attached to main in-line handle 16 on its front face via a suitable pivot pin 20. This pivot attachment enables the in-line arm 18 to swing radially outwardly from the handle 16 within an optimal range of angular rotation about the vertical axis perpendicular to the front face of the main in-line handle 16. Thus the second razor blade head assembly 14 augments the total shaving area covered by the first razor blade head assembly 12 with a wider cut for each stroke of shaving.

Figure 2:
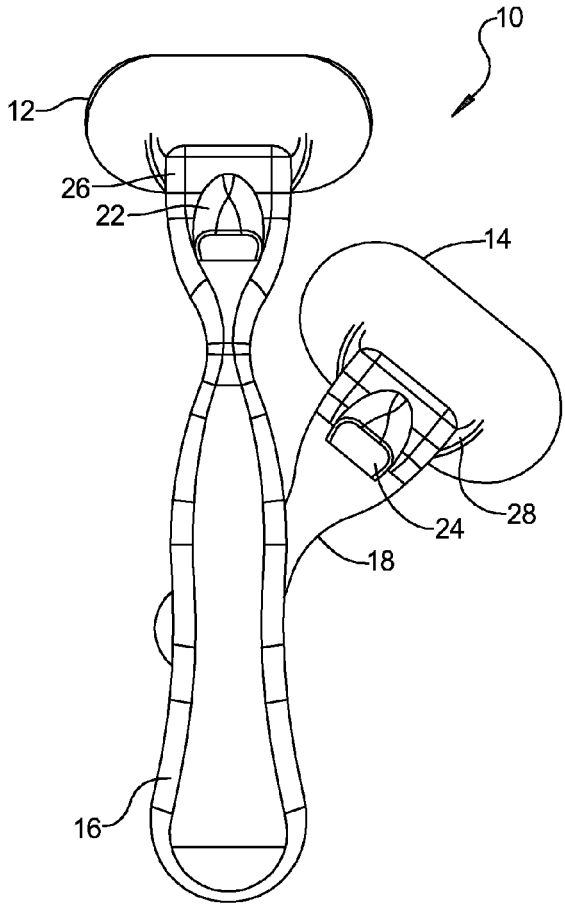
FIG. 2 is a rear view of the dual headed razor blade system according to the invention.

As shown in FIG. 2, the first blade support 26 is mounted to the upper end and on the front face of the main in-line handle 16, and preferably projects forward therefrom. The second blade support 28 is similarly mounted to the upper end of the second handle or arm 18, and preferably projects forward therefrom on the same plane of the first blade support 26. As shown in FIG. 2, the rear surface or face of the second handle 18 has a projection or nub projecting outwardly therefrom and which removably seats in the recess 19 to ordinarily render the second assembly stationary and stowable when not pivoted radially laterally therefrom.

Figure 3:
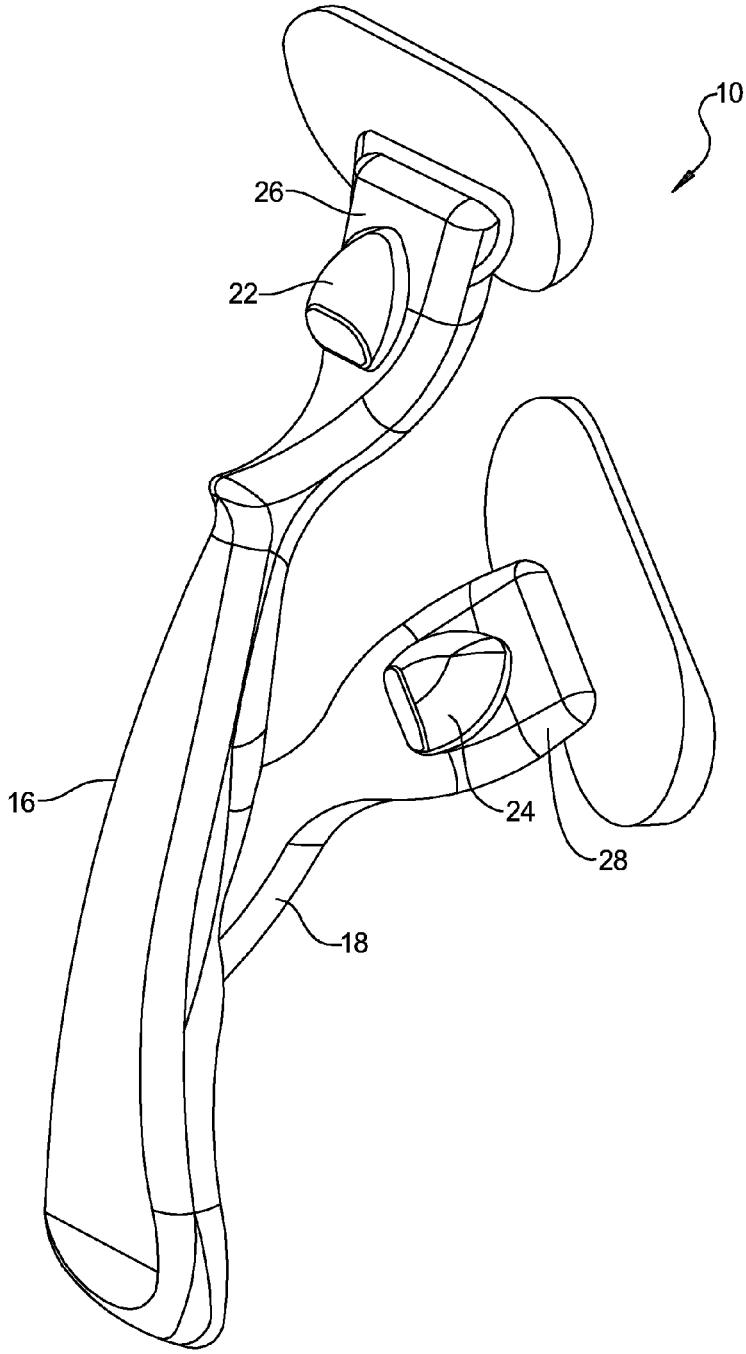
FIG. 3 is a side isometric view of the dual headed razor blade system according to the invention.

First and second razor blade head assemblies 12, 14 may be releasably locked to the respective first and second blade supports 26, 28 so that the razor blade head assemblies may be replaced, removed, and disposed of, following shaving. As shown in FIG. 2 and FIG. 3, first razor blade head assembly 12 is engaged to the first blade support 26 by means of a releasable locking means 22, similarly, the second razor blade head assembly 14 is engaged to the second blade support 28 by means of a releasable locking means 24. The first razor blade head assembly 12 may be pivotally and releasably engaged to first blade support 26 by using the locking means 22, similarly, the second razor blade head assembly 14 may be pivotally and releasably engaged to second blade support 28 by using the locking means 24. It is to be understood that, the razor blade head assemblies 12, 14 may be replaced, removed, or disposed of independent of each other or simultaneously depending upon the user's fancy and needs.

It is to be understood that, the present invention is not limited to the embodiments described herein, but encompasses any and all embodiments within the scope of the following claims.

Having described the invention what is claimed is:

1. A dual headed razor blade system, comprising:

an elongated in-line handle having opposed upper and lower ends, and opposed front and rear faces; the elongated in-line handle further includes a concave recess on its front face and toward the lower end;

a first blade support projecting from the upper end and perpendicularly sitting on the front face of the in-line handle, the first blade support having a first blade mount defining a first width, the first blade mount being adapted for mounting a first razor blade head assembly;

a second blade support projecting from a distal end of an in-line arm having opposed upper and lower ends and opposed front and rear faces, the lower end of the in-line arm is attached with its rear face in the concave recess of the in-line handle, the second blade support having a second blade mount defining a second width, the second blade mount being adapted for mounting a second razor blade head assembly, the first blade mount width and the second blade mount width being essentially equal, the second blade support substantially coplanar with and extending slightly lower than the first blade support, whereby the second razor blade head assembly augments the total shaving area to a maximum for each stroke of cutting when the dual headed razor blade assembly is moved on a hairy skin surface of a body.

2. The dual headed razor blade system as claimed in claim 1, wherein the in-line arm supporting the second blade support is relatively shorter than the in-line handle; thereby the second razor blade head assembly sits slightly lower on the front face of the in-line handle than the first razor blade head assembly of the dual headed razor blade system.

3. The dual headed razor blade system as claimed in claim 2, wherein the lower end of the in-line arm supporting the second blade support is pivotally attached on its rear face at the concave recess of the in-line handle of the dual headed razor blade system whereby, the second razor blade head assembly swings optimally on either sides of the in-line handle of the dual headed razor blade system.

4. The dual headed razor blade system as claimed in claim 1, wherein the first and the second razor blade head assemblies each comprises disposable razor blade cartridges releasably mounted to the first and second blade mounts respectively.

5. The dual headed razor blade system as claimed in claim 4, wherein the first and second razor blade head assemblies are pivotally and releasably engaged to the first and second blade supports respectively.

* * * * *